US007168476B2

(12) United States Patent
Chen

(10) Patent No.: US 7,168,476 B2
(45) Date of Patent: Jan. 30, 2007

(54) CORDLESS ACTIVATING DEVICE FOR A VENETIAN BLIND

(76) Inventor: Chin-Fu Chen, Room B, 25F, No. 51, Sec. 2, Gungyi Rd., Nantun Dist., Taichung (TW)

( * ) Notice: Subject to any disclaimer, the term of this patent is extended or adjusted under 35 U.S.C. 154(b) by 190 days.

(21) Appl. No.: 10/951,634

(22) Filed: Sep. 29, 2004

(65) Prior Publication Data

US 2006/0065373 A1 Mar. 30, 2006

(51) Int. Cl.
*E06B 9/322* (2006.01)

(52) U.S. Cl. ..... 160/170

(58) Field of Classification Search ..... 160/170, 160/171, 84.04, 84.05, 84.06, 192; 185/37, 185/39, 45; 242/373
See application file for complete search history.

(56) References Cited

U.S. PATENT DOCUMENTS 6,024,154 A * 2/2000 Wang et al. ..... 160/170
6,283,192 B1 * 9/2001 Toti ..... 160/170
6,330,899 B1 * 12/2001 Ciuca et al. ..... 160/170
6,761,203 B1 * 7/2004 Huang ..... 160/170
6,823,925 B2 * 11/2004 Militello et al. ..... 160/170

* cited by examiner

*Primary Examiner*—David Purol
(74) *Attorney, Agent, or Firm*—Lowe Hauptman & Berner, LLP

(57) ABSTRACT

A cordless activating device for a venetian blind has a central reeling device, two string-guides and a main string. The central reeling device has a U-shaped mounting bracket, a resilient coiling device and a clutch. The resilient coiling device comprises a spring spool, a take-up reel and a specifically designed S-shaped recoiling spring. The clutch selectively locks the resilient coiling device in place and activates the resilient coiling device. The string-guides are mounted on opposite ends of the central reeling device. The main string is attached to and controlled by the central reeling device, is wound around the two string-guides and the resilient coiling device and is connected to two draw strings that extend down through the venetian blind. When the clutch activates the resilient coiling device, the resilient coiling device winds the main string onto the take-up reel, and the venetian blind automatically rises.

7 Claims, 13 Drawing Sheets

CORDLESS ACTIVATING DEVICE FOR A VENETIAN BLIND

BACKGROUND OF THE INVENTION

1. Field of the Invention

The invention relates to an activating device, and more particularly to a cordless activating device attached to a venetian blind to raise or lower a venetian blind without using an external pull-cord.

2. Description of Related Art

With reference to FIGS. 11 to 13, a conventional cordless activating device in accordance with the prior art for a venetian blind, which has a top side and a bottom side attached to a bottom of the venetian blind. The conventional cordless activating device comprises a cord winding assembly and a brake assembly (20).

The cord winding assembly comprises a string winding device (12) and a spring winding device (14). The string winding device (12) has an extension shaft (122) and two string spools (126). The extension shaft (122) has two ends (not numbered) and a middle section (not numbered) and is non-circular and preferably polygonal. The two string spools (126) are mounted respectively on the two ends of the extension shaft (122) to wind or unwind two strings (not shown) attached to a top rail (not shown) of a venetian blind (not shown).

The spring winding device (14) is mounted on the middle section of the extension shaft (122) and has a figure 8-shaped housing (141), an S-shaped drive spring (142), a drive spool (144) and at least one ratchet wheel (146). The figure 8-shaped housing (141) has a take-up chamber (not numbered), a positioning post (1412) and a drive chamber (not numbered). The positioning post (1412) is formed inside the take-up chamber. The drive spool (144) has two ends (not numbered), two protruding non-circular keys (not numbered) and a non-circular through hole (not numbered) corresponding to the non-circular extension shaft (122), is mounted rotatably inside the drive chamber of the S-shaped housing (141) and is mounted securely on a center segment of the extension shaft (122). The S-shaped drive spring (142) is mounted inside the figure 8-shaped housing (141) and has a stationary end (not numbered) attached to the positioning post (1412) and a rotating end attached to the driving spool (144). The drive spring (142) is wound on the position post (1412) when the venetian blind is in an up position against the top rail and causes the extension shaft (122) to rotate and wind the strings respectively onto the two spools (126) to move the venetian blind upward. Each ratchet wheel (146) has a central keyed through hole (not numbered) and is mounted around the middle section of the extension shaft (122). The ratchet wheels (146) are attached respectively to protrude non-circular keys on the drive spool (144).

The brake assembly (20) comprises a mounting bracket (21), an activating grip (22) and two springs (23).

The mounting bracket (21) holds the string winding assembly, has two posts (211) and is mounted transversely to the extension rod (122) and in line with the figue 8-shaped housing (141). The posts (211) are parallel and adjacent respectively to the sides of the figure 8-shaped housing (141).

The activating grip (22) is U-shaped, mounted slidably on the mounting bracket (21) and has an inner face (not numbered), two distal ends (not numbered), two blind holes (224) and two pawls (222). The two blind holes (224) are defined respectively and longitudinally in the two distal ends and slidably hold the posts (211) on the mounting bracket (21). The two pawls (222) are formed on the inner face respectively near the two distal ends to selectively engage the ratchet wheels (146).

The springs (23) are mounted respectively around the posts (211) between the mounting bracket (21) and the distal ends of the activating grip (22). The springs (23) press the activating grip (22), cause the pawls (222) to engage the corresponding ratchet wheels (146), keep the extension shaft (122) and string spools (126) from rotating and hold the venetian blind in position when the activating grip (22) is released.

With particular reference to FIG. 13, the pawls (222) detach from the ratchet wheels (146) when the activating grip (22) is pressed toward the mounting bracket (21) so the extension shaft (122) can rotate and take-up or let out the strings to adjust the Venetian blind. After the venetian blind is adjusted, the activating grip (22) is released, and the pawls (222) engage the ratchet wheels (124) again to keep the extension shaft (122) from rotating so the venetian blind is held in position.

However, the conventional cordless activating device for a venetian blind still has some drawbacks. For example, the extension shaft (122) in the string winding assembly is thin and long so that the extension shaft (122) easily breaks during rotation especially when the venetian blind is very wide, which cause a strong torsional force to be applied to the string spools (124). Therefore, the conventional cordless activating device is not durable.

The present invention has arisen to provide a cordless activating device mounted on a venetian blind, which eliminates or obviates the drawbacks of the conventional cordless activating device.

SUMMARY OF THE INVENTION

The main objective of the present invention is to provide a cordless activating device for a venetian blind, which is convenient to use and is durable.

To achieve the foregoing objective, the cordless activating device in accordance with the present invention for a venetian blind comprises a central reeling device, two string-guides and a main string. The central reeling device has two ends, a U-shaped mounting bracket, a resilient coiling device and a clutch. The resilient coiling device comprises a spring spool, a take-up reel and a specially designed S-shaped recoiling spring. The clutch selectively locks the resilient coiling device in place and activates the resilient coiling device. The string-guides are mounted on opposite ends of the central reeling device. The main string is attached to and controlled by the central reeling device, is wound around the two string-guides and the resilient coiling device and is connected to two draw strings that extend down through the venetian blind. When the clutch activates the resilient coiling device, the resilient coiling device winds the main string onto the take-up reel and the venetian blind automatically lifts up.

Further benefits and advantages of the present invention will become apparent after a careful reading of the detailed description in accordance with the drawings.

DETAILED DESCRIPTION OF THE PREFERRED EMBODIMENT

Figure 1:
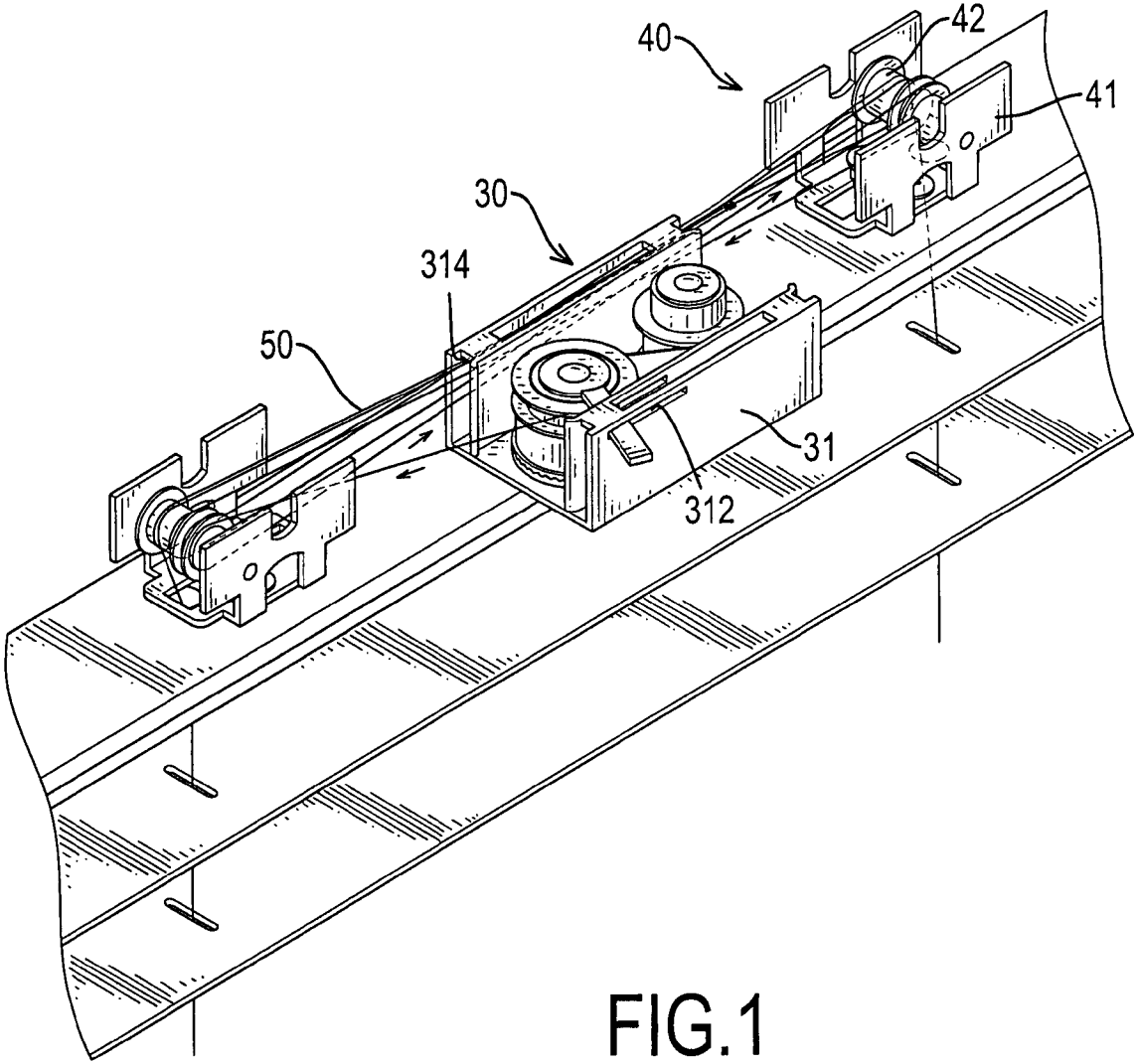
FIG. 1 is a perspective view of a cordless activating device in accordance with the present invention for a venetian blind.

With reference to FIG. 1, a cordless activating device in accordance with the present invention for a venetian blind having multiple slats and a bottom, the cordless activating device comprises a central reeling device (30), two string-guides (40) and a main string (50). The central reeling device (30) has two ends, a U-shaped mounting bracket (31), a resilient coiling device and a clutch. The two string-guides (40) are mounted on the venetian blind on opposite ends of the central reeling device (30). The main string (50) is attached to the resilient coiling device on the central reeling device (30), winds around and extends between the two string-guides (40) and then connects to two branched strings that extend down through the slats and attach to the bottom of the venetian blind. When the clutch disengages the resilient coiling device, the central reeling device rewinds the main string, which pulls the branched strings up around the string-guides (40) and automatically raises the venetian blind.

Figure 2:
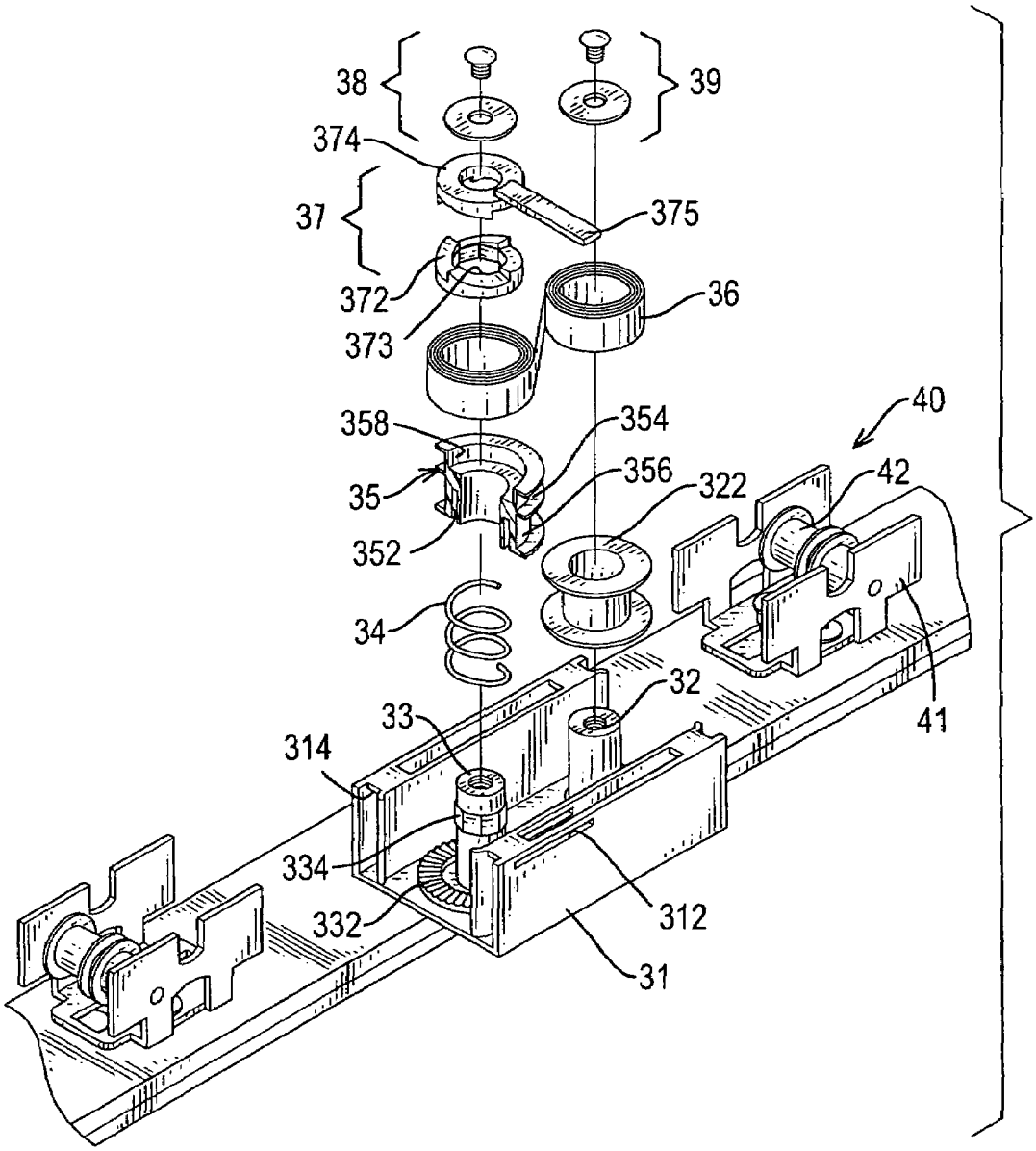
FIG. 2 is a partially exploded perspective view of the cordless activating device in FIG. 1.
Figure 3:
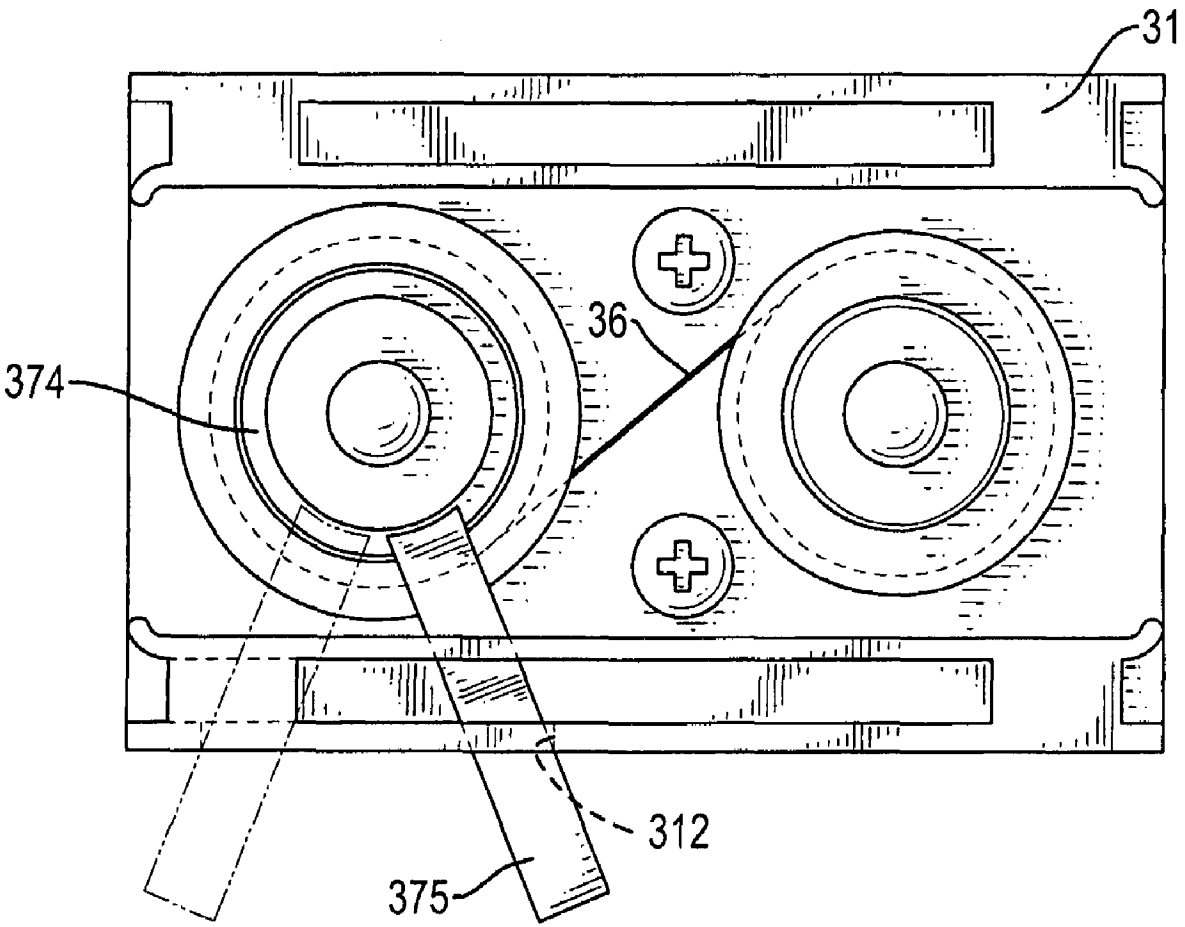
FIG. 3 is an operational top view of a central reeling device in the cordless activating device of FIG. 2.
Figure 4:
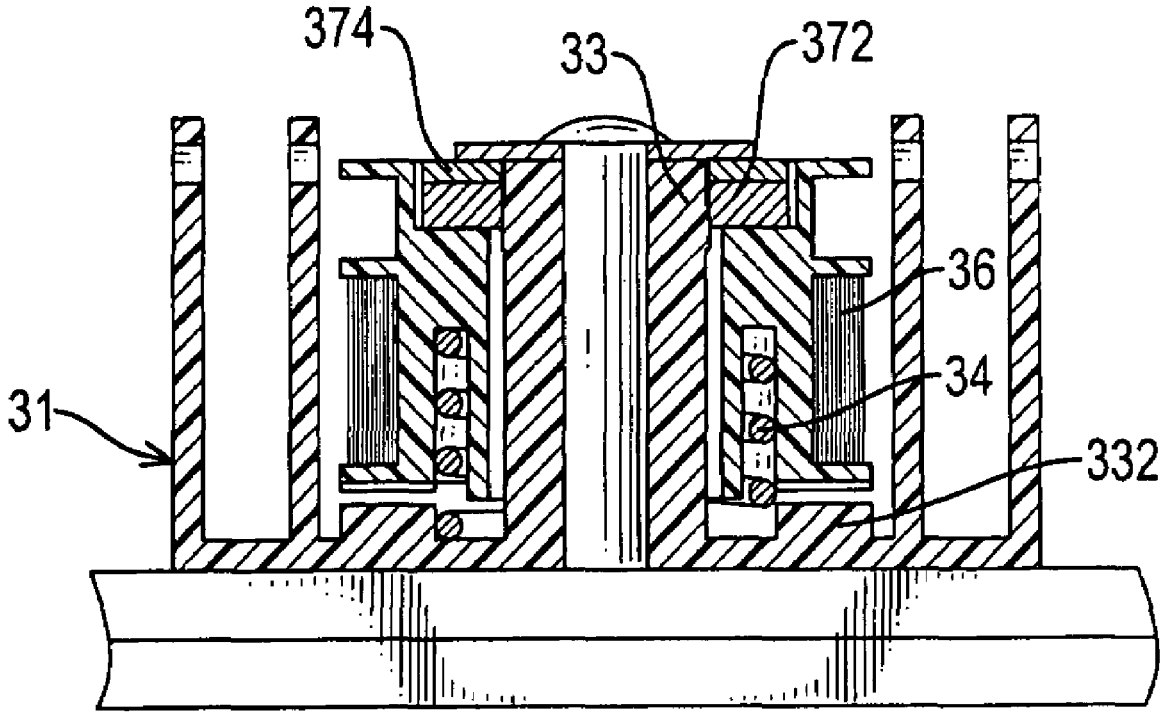
FIG. 4 is a cross-sectional side view of a clutch cam and a mounting bracket on the central reeling device of the cordless activating device in FIG. 1 when the clutch cam is not engaged with the base.
Figure 5:
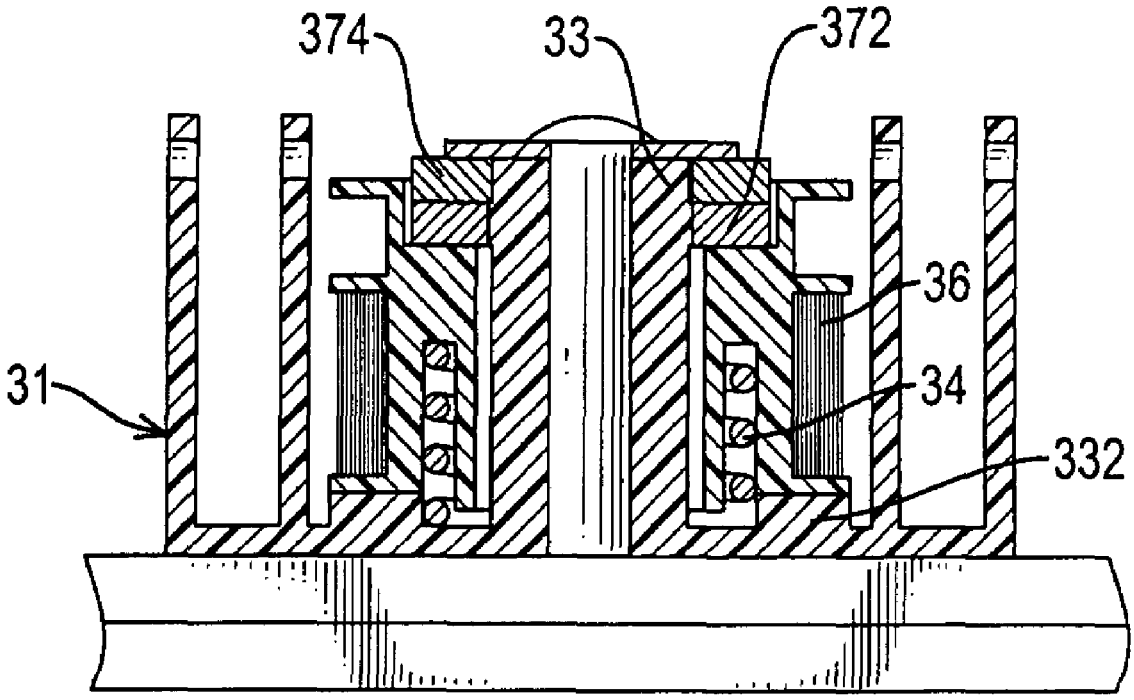
FIG. 5 is an operational cross-sectional side view of the clutch cam and the mounting bracket on the central reeling device of the cordless activating device in FIG. 1 when the clutch cam is engaged with the base.

With further reference to FIG. 2, the U-shaped mounting bracket (31) in the central reeling device (30) has a bottom, a front wall, a rear wall, a recess, a positioning post (32), a ratchet post (33) and an annular toothed ring (332). The recess is defined between the front and the rear walls. The front wall has a top edge, an optional longitudinal slot (312), an optional cutout and a longitudinal string channel (314). The longitudinal slot (312) is defined through the front wall near the top edge. The cutout is defined on the top edge of the front wall. The longitudinal string channel (314) is optionally and longitudinally through the front wall or the rear wall or both of the two wall have the longitudinal core channels (314). The positioning post (32) is formed on the bottom inside the recess and has a distal end. The ratchet post (33) is formed on the bottom of the U-shaped mounting bracket (31) inside the recess and has an outer surface, a distal end and a non-circular annular section (334). The non-circular annular section (334) is formed on the outer surface near the distal end of the ratchet post (33) and may be polygonal or any other non-circular shape. The annular toothed ring (332) is formed concentrically around the ratchet post (33) on the bottom of the U-shaped mounting bracket (31).

The resilient coiling device is composed of a spring spool (322), a take-up reel (35) and an S-shaped recoiling spring (36).

Figure 9:
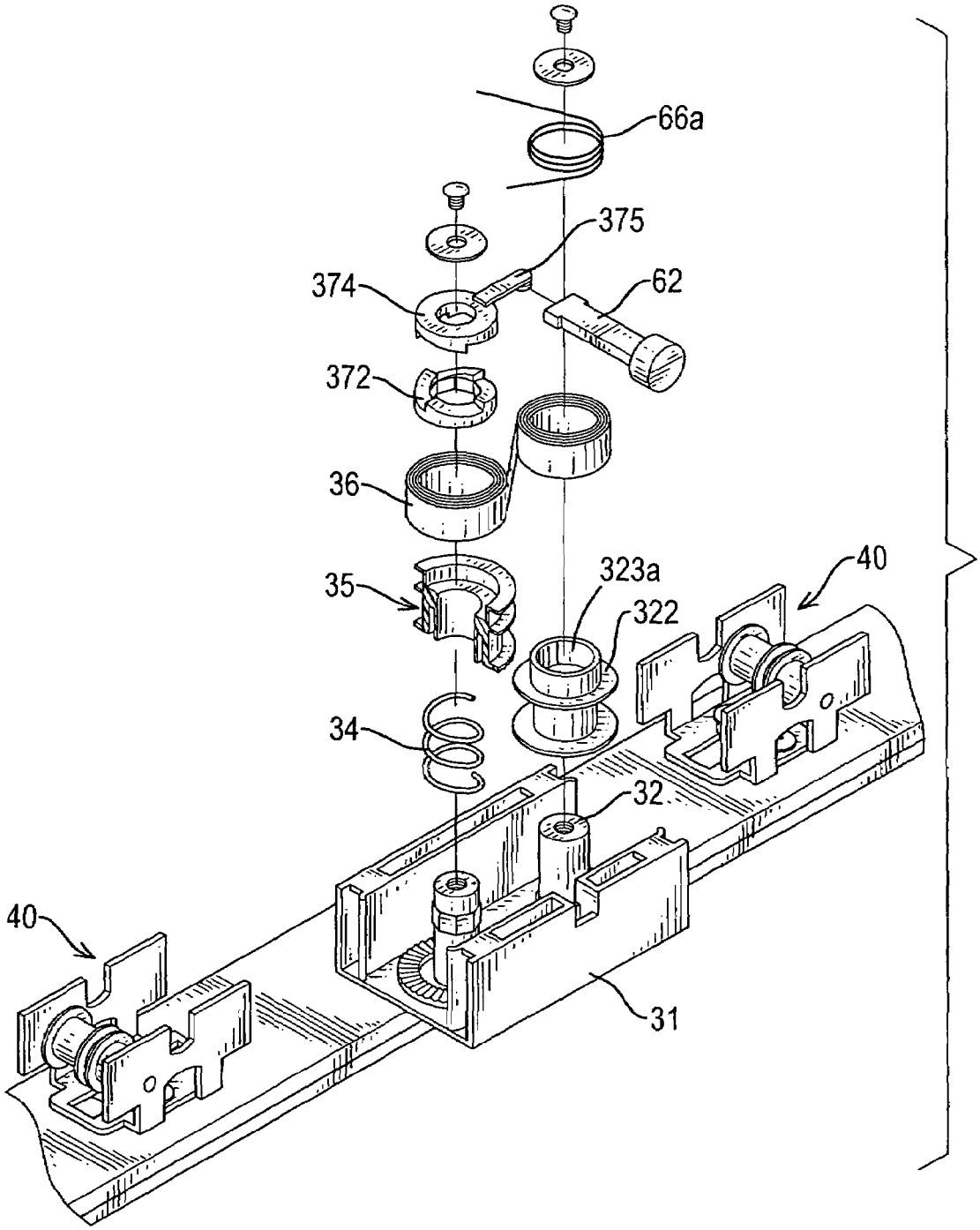
FIG. 9 is a partially exploded perspective view of another embodiment of the cordless activating device in accordance with the present invention.

The spring spool (322) is mounted on and attached securely to the positioning post (32) with a screw and washer set (39) and has a top and an optional spring post (323*a*) as shown in FIG. 9. The spring post (323*a*) is formed on and extends longitudinally from the top.

The take-up reel (35) is rotatably mounted on the ratchet post (33) below the non-circular annular section (334) and has a bottom, a top, an outer surface, a coil spring chamber (352), multiple teeth, a string reeling area (354), a spring reeling area (356) and a cam recess (358). The coil spring chamber (352) is annular and concentrically defined longitudinally in the bottom of the take-up reel (35). The multiple teeth are formed radially on the bottom of the take-up reel (35) around the coil spring chamber (352). The spring reeling area (356) is defined around the outer surface near the bottom. The string reeling area (354) is defined around the outer surface above the spring reeling area (356). The cam recess (358) is defined concentrically in the top of the take-up reel (35).

The S-shaped recoiling spring (36) is a specifically designed coiled band-type spring that provides a strong restitution force and has an internal end and an external end. The internal end is attached to the spring spool (322), and the external end is attached to the spring reeling area (356) on the take-up reel (35). Thereby, the S-shaped recoiling spring (36) provides a restitution force on the take-up reel (35) to drive the take-up reel (35) to rotate after the clutch release the resilient coiling device.

The clutch is composed of a coil spring (34), a cam assembly (37) and an optional lever actuating assembly (60). The clutch selectively causes the multiple teeth on the bottom of the take-up reel (35) to engage or disengage from the annular toothed ring (332) in the U-shaped mounting bracket (31).

The coil spring (34) is mounted in the coil spring chamber (352) in the take-up reel (35) and presses against the bottom of the U-shaped mounting bracket (31) to selectively disengage the multiple teeth on bottom of the take-up reel (35) from the annular toothed ring (332).

The cam assembly (37) comprises a lower cam (372) and an upper cam (374) and selectively presses the take-up reel (35) down so the multiple teeth on the bottom engage the annular toothed ring (332) to hold the take-up reel (35) in place.

The lower cam (372) is mounted slidably inside the cam recess (358) and slidably but not rotatably on the ratchet post (33) and has a non-circular hole (373), an abutting top face, multiple convex segments and multiple concave segments. The non-circular hole (373) is defined through the lower cam (372) and corresponds to and engages the non-circular section (334) on the ratchet post (33) to keep the lower cam (372) from rotating but allowing it to slide longitudinally on the non-circular section (334) on the ratchet post (33). The multiple convex segments and concave segments are formed alternately on the abutting top face.

Figure 6:
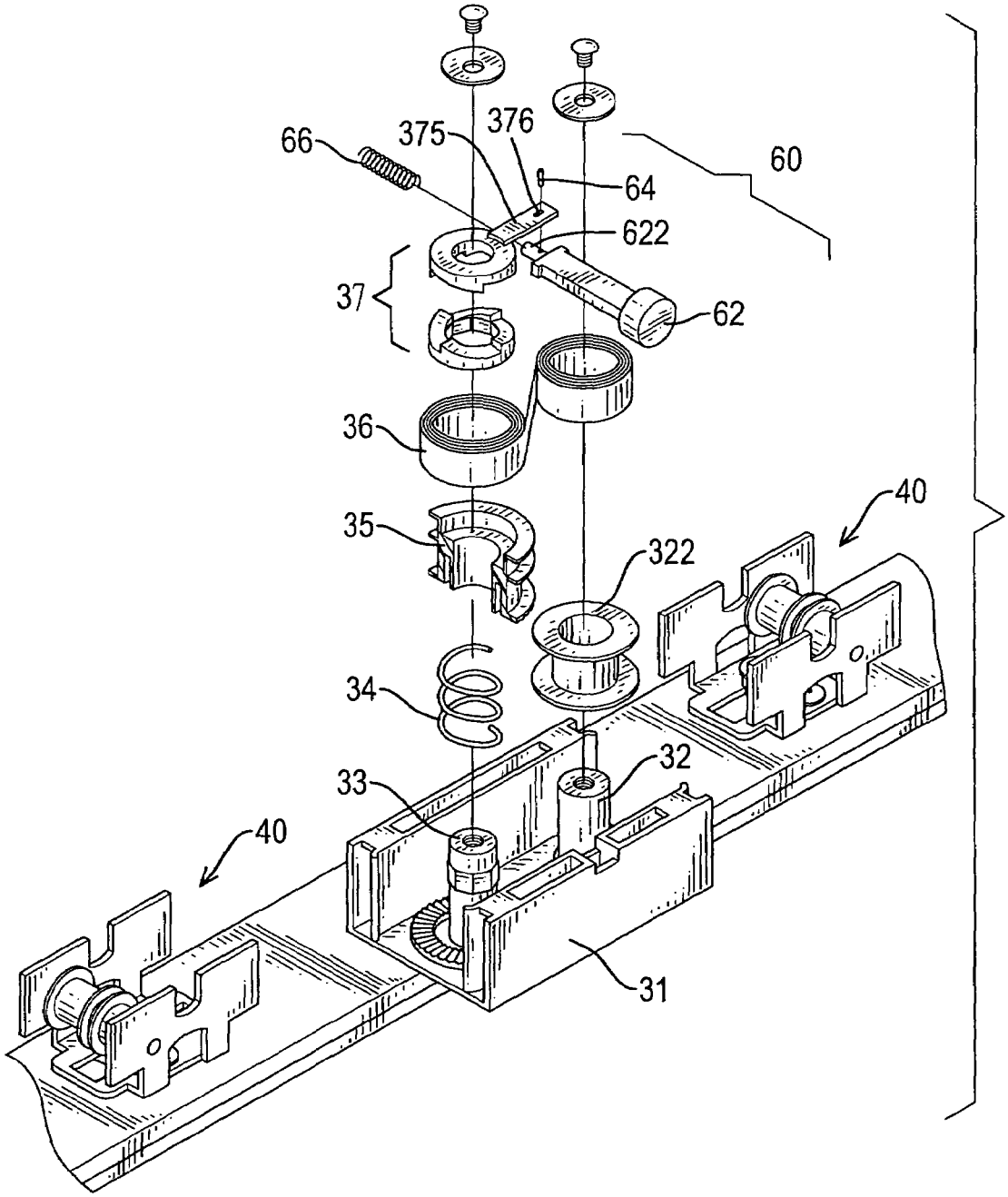
FIG. 6 is a partially exploded perspective view of another embodiment of the cordless activating device in accordance with the present invention, wherein the central reeling device further has a push shaft.

The upper cam (374) is rotatably mounted above the lower cam (372) on the ratchet post (33) by a screw and washer set (38) and has a central hole, a top face, an abutting bottom face, multiple concave segments, multiple convex segments and an actuating lever (375). The central hole is defined through the upper cam (374) to make the upper cam (374) to mount rotatably around the distal end of the ratchet post (33). The abutting bottom face presses against the abutting top face of the lower cam (372). The multiple convex segments and concave segments are formed alternately on the abutting bottom face. The multiple convex segments selectively press against the convex segments on the lower cam (372) to move the lower cam (372) and the take-up reel (35) on the ratchet post (33) and cause the multiple teeth on the bottom of the take-up reel (35) to engage the annular toothed ring (332) and hold the take-up reel (35) in place. The actuating lever (375) has a distal end and an optional longitudinal elongated slot (376) as shown in FIG. 6 and is formed on and extends radially from the top face of the upper cam (374) to rotate the upper cam (374). The longitudinal elongated slot (376) is formed through the actuating lever (375) near the distal end. When the lever (375) is rotated, the multiple convex segments press against the convex segments on the lower cam (372) to move the lower cam (372) down. When the lower cam (372) moves down, the take-up reel (35) is pressed down, and the multiple teeth on the bottom of the take-up reel (35) engage the annular toothed ring (332) and lock the reel spool (35) in place.

With reference to FIGS. 1 to 5, the actuating lever (375) extends through the longitudinal slot (312) in the front wall of the U-shaped mounting bracket (31). Manually moving the actuating lever (375) in the longitudinal slot (312) rotates the upper cam (374) and moves the lower cam (372) to lock or unlock the take-up reel (35). The actuating lever (375) drives convex segments of the upper cam (374) to engage with the concave segments of the lower cain (372). Thereby, the take-up reel (35) does not engage with the annular toothed ring (332) and are rotatable to wind the main string (50) or the corresponding end of the S-shaped recoiling spring (36).

When the venetian blind is extended the bottom of the venetian blind is pulled down to draw out the two branched strings and the main string (50) out of the coil reeling area (354) on the take-up reel (35). Meanwhile, the take-up reel (35) is driven to wind the corresponding end of the S-shaped recoiling spring (36) to store restitution force. Then, the actuating lever is driven to make the convex segments on the upper cam (374) to engage with the convex segments on the lower cam (372). Thereby, the take-up reel (35) is pushed down to engage with the annular toothed ring (332) to lock the resilient coiling device and to keep the venetian blind in position. When the venetian blind is folded, the clutch release the resilient coiling device and the restitution force is released to drive the take-up reel (35) to rewind the main string (50) back to the string reeling area (354). Thereby, the venetian blind automatically raises by the restitution force from the S-shaped recoiling spring (36).

With reference to FIGS. 6 to 10, in a second and third embodiment of the cordless activating device in accordance with the present invention, the lever actuating assembly (60) is comprised of a shaft (62), an optional pin (64) and a resilient element. The resilient element may be a coil spring (66) or a torsional spring (66*a*).

The shaft (62) is slidably mounted on the cutout defined in the front wall of the U-shaped mounting bracket (31) and has a proximal end, a distal end, an optional protruding coaxial rod (622) and an optional pin hole. The proximal end is attached to the actuating lever (375) in the second embodiment, abuts the actuating lever (375) in the third embodiment and selectively pushes the actuating lever (375) inward. The distal end extends outside the front wall to be pressed by a user to release the take-up reel (35). The protruding coaxial rod (622) is formed on and extend from the proximal end of the shaft (62), and the pin hole is formed radially in the protruding coaxial rod (622).

Figure 7:
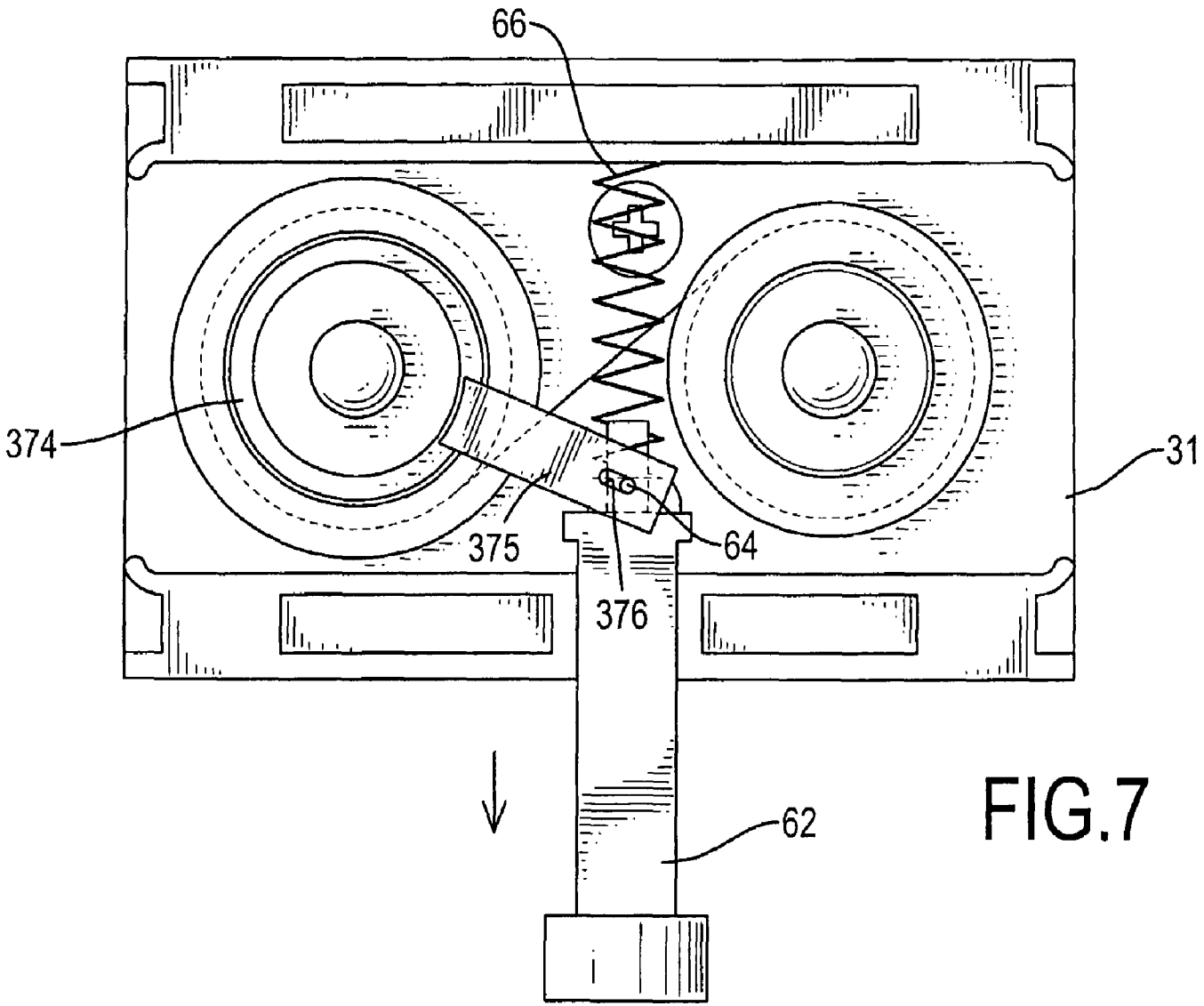
FIG. 7 is a top view of the push shaft in the central reeling device in FIG. 6.
Figure 8:
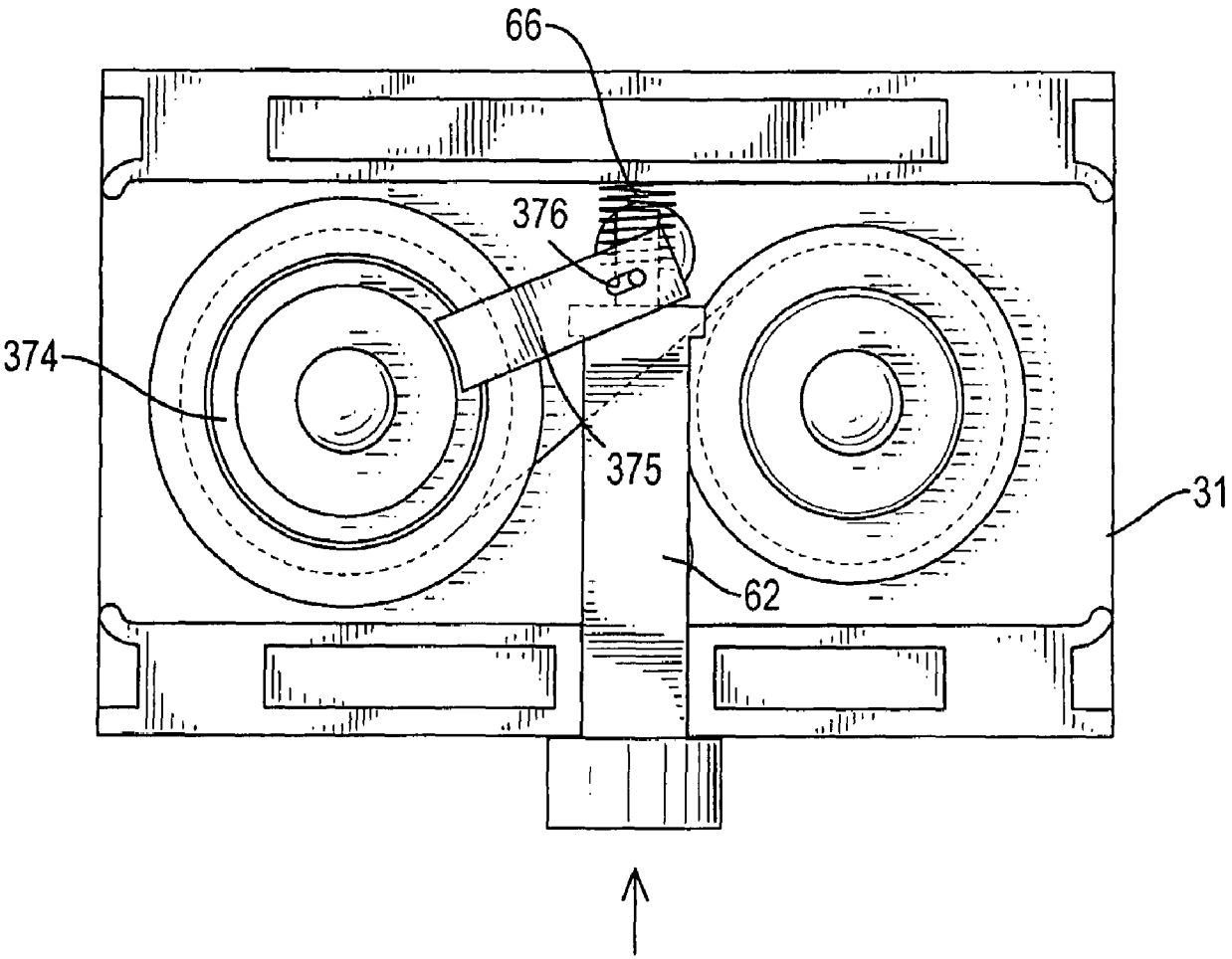
FIG. 8 is an operational top view of the push shaft in the central reeling device in FIG. 7.

With further reference to FIGS. 6 to 8, the pin (64) is mounted in the longitudinal elongated slot (376) in the actuating lever (375) and the pin hole in the protruding coaxial rod (622) to connect the shaft (62) to the actuating lever (375). The coil spring (66) is mounted around the protruding coaxial rod (622) and against the rear wall of the U-shaped mounting bracket (31) to press the shaft (62) outward rotate the actuating lever (375), press the take-up reel (35) down and lock the take-up reel (35) in position when the multiple teeth engage the annular toothed ring (332).

Figure 10:
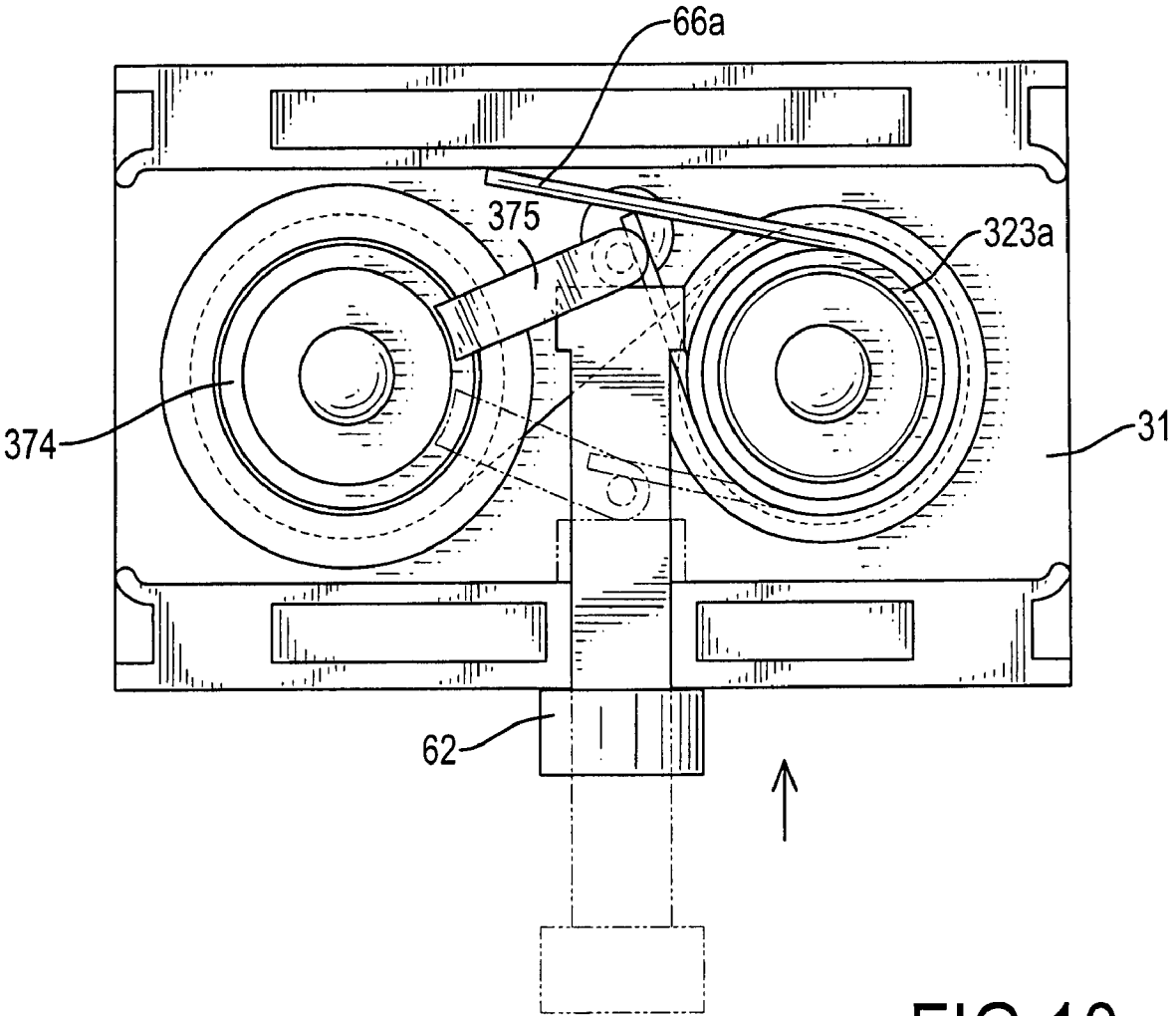
FIG. 10 is an operational top view of the central reeling device in the cordless activating device in FIG. 9.
Figure 11:
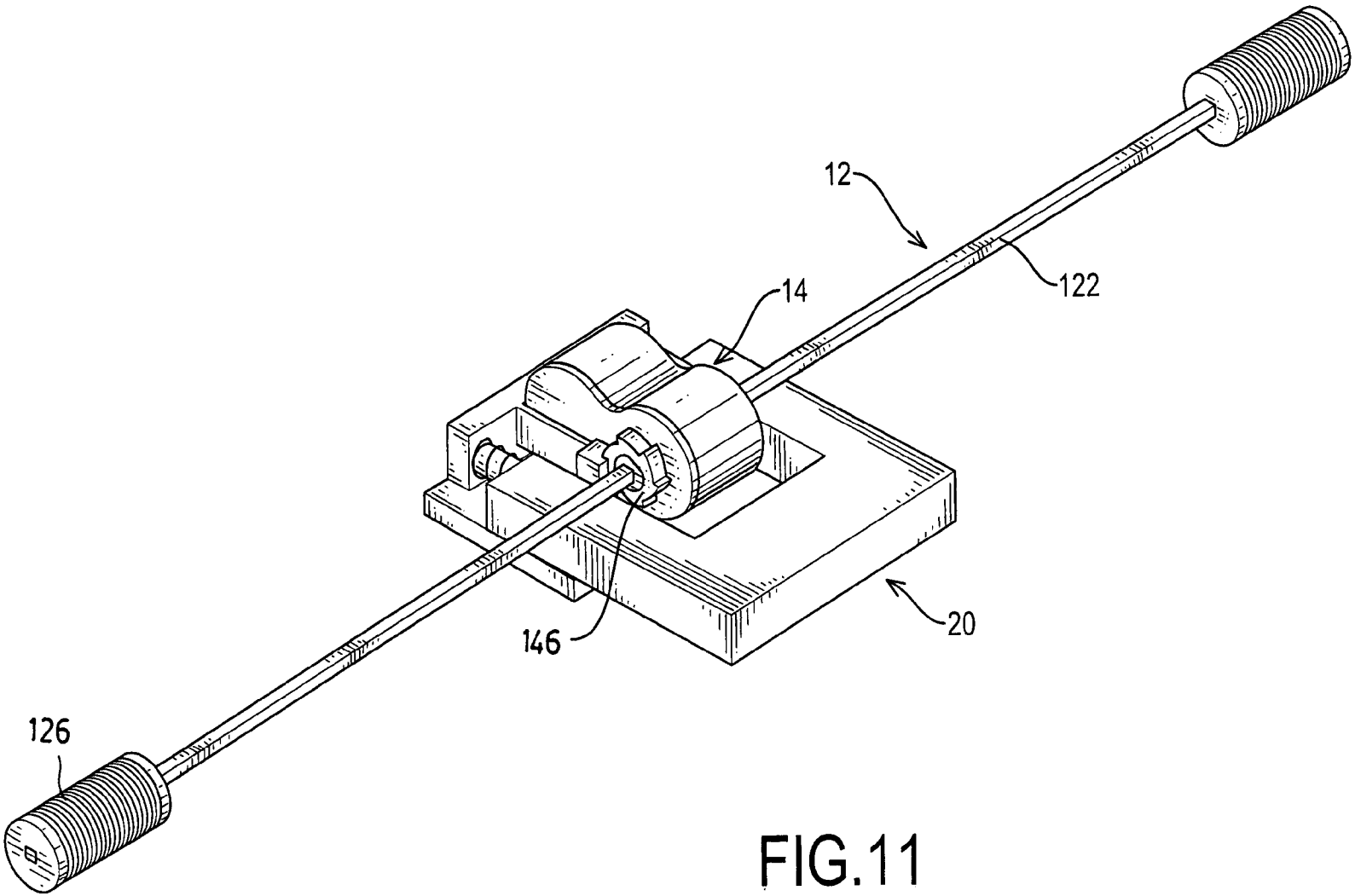
FIG. 11 is a perspective view of a conventional cordless activating device in accordance with the prior art.
Figure 12:
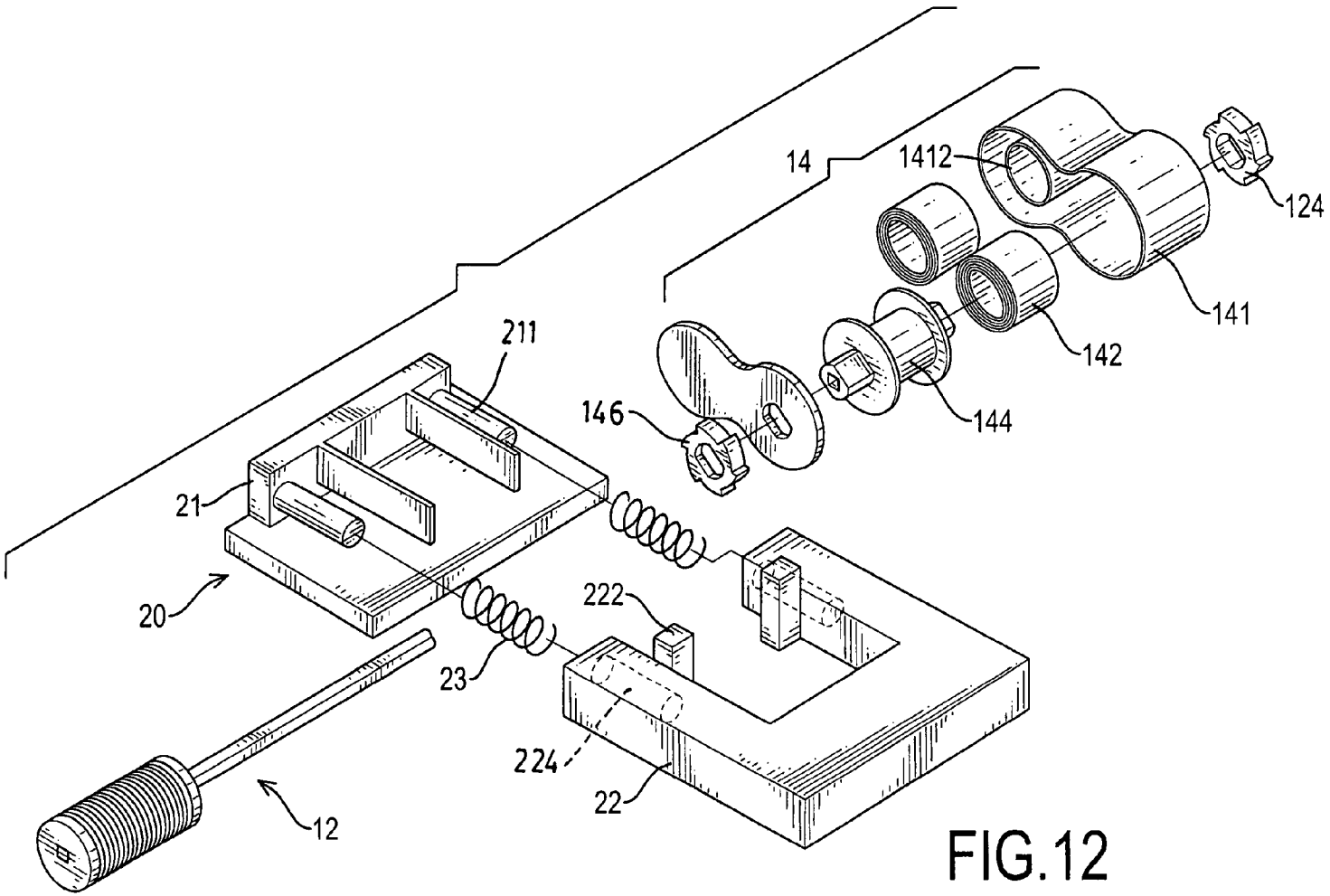
FIG. 12 is an exploded perspective view of the conventional cordless activating device in FIG. 11.
Figure 13:
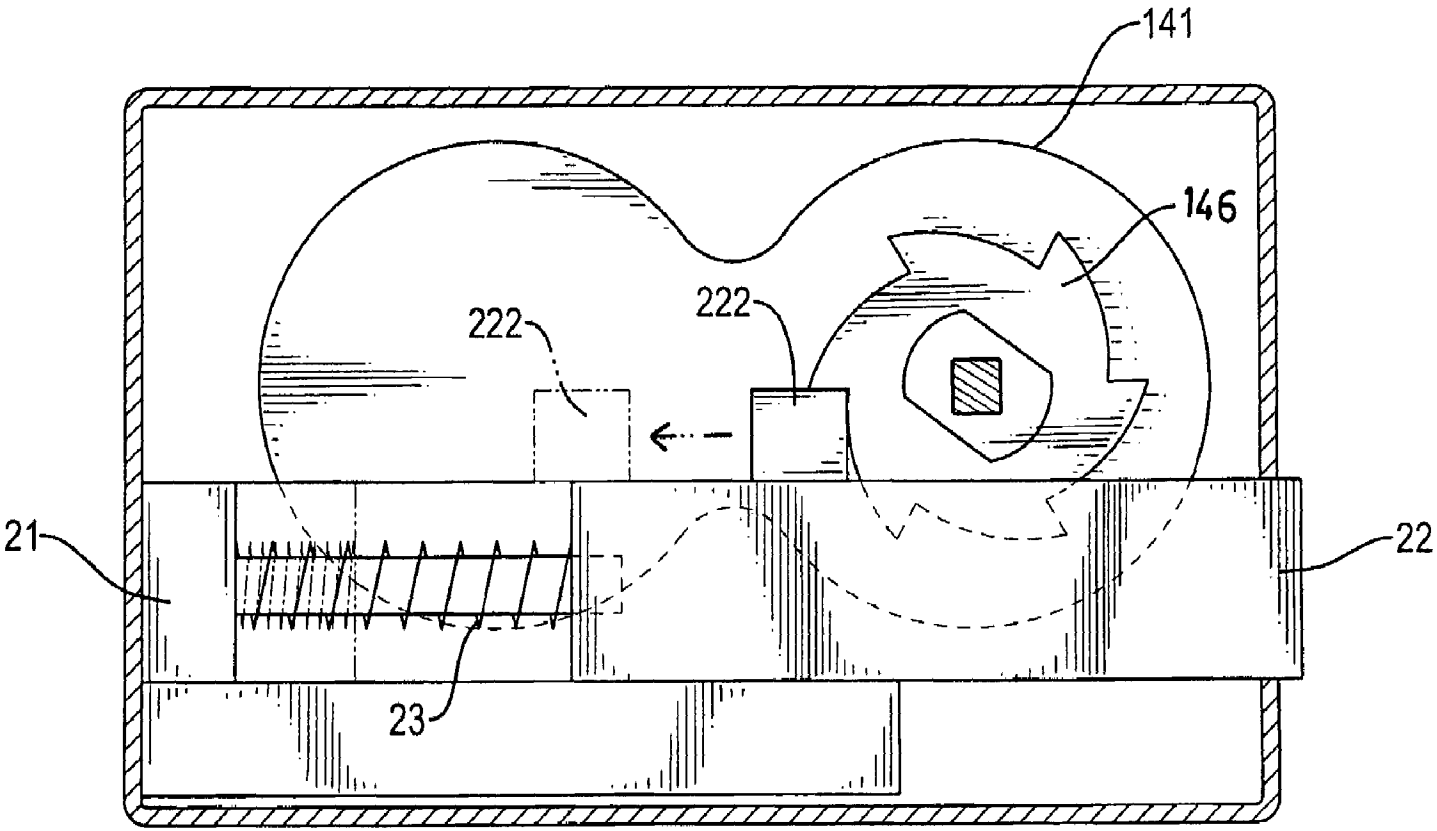
FIG. 13 is an operational side view in partial section of the conventional cordless activating device in FIG. 11.

With further reference to FIGS. 9 and 10, the third embodiment has the torsional spring (66*a*) mounted around the spring post (323*a*) on the spring reel (322). The torsional spring (66*a*) has two ends. One end abuts the rear wall of the U-shaped mounting bracket (31), and the other end presses against the actuating lever (375) to press the shaft (62) and the actuating lever (375) toward the front wall of the U-shaped mounting bracket (31). Correspondingly, the actuating lever (375) on the upper cam (374) has a perpendicular abutting post formed near the distal end to engage with the other end of the torsional spring (66*a*)

With reference to FIGS. 1 and 2, the string-guides (40) are mounted on the venetian blind on opposite ends of the central reeling device (30). Each string-guide (40) is composed of a sheave mounting bracket (41) and a sheave (42) rotatably mounted on the sheave mounting bracket (41).

The main string (50) is securely attached to and winds around the string reeling area (354) on the take-up reel (35), loops around the two sheaves (42) respectively on the string-guides (40) and connects to two branching strings that pass through the slats of the venetian blind. Preferably, the main string (50) looped around the string-guides (40) passes through the string channel (314) in the U-shaped mounting bracket (31).

As described, the cordless activating device in accordance with the present invention uses a central reeling device (30), two string-guides (40) and a main string (50) rather than a long drive shaft to transmit force to drive and control the venetian blind. Without the torsion force applied in a long drive shaft in the conventional activating device, lifting force is transmitted more easily and accurately and the activating device is much more durable.

Although the invention has been explained in relation to its preferred embodiment, many other possible modifications and variations can be made without departing from the spirit and scope of the invention as hereinafter claimed.

What is claimed is:

1. A cordless activating device for a venetian blind having multiple slats, the cordless activating device comprising:

a central reeling device having a U-shaped mounting bracket;

a bottom;

a front wall having a top edge; and a string channel defined longitudinally through the front wall;

a rear wall having a string channel defined longitudinally through the rear wall;

a recess formed between the front wall and the rear wall;

a positioning post formed on the bottom of the U-shaped mounting bracket inside the recess and having a distal end;

a ratchet post formed on the bottom of the U-shaped mounting bracket inside the recess and having:

an outer surface;

a distal end; and a non-circular section formed on the outer surface near the distal end of the ratchet post; and an annular toothed ring formed on the bottom of the U-shaped mounting bracket and around the ratchet post;

a resilient coiling device mounted on the U-shaped mounting bracket; and having a spring spool mounted on and attached securely to the positioning post with a screw and a washer set and having a top;

a take-up real rotatably mounted on the ratchet post below the non-circular section and having a bottom;

a top;

an outer surface;

a coil spring chamber being annular and defined longitudinally in the bottom of the take-up reel;

multiple teeth formed radially on the bottom of the take-up reel around the coil spring chamber to selectively engage the annular toothed ring;

a spring reeling area defined around the outer surface of the take-up near the bottom;

a string reeling area defined around the outer surface of the take-up reel above the spring reeling area; and an S-shaped recoiling spring being a specifically designed coiled band-type spring that provides a restitution force and has an internal end attached to the spring spool; and an external end attached to the spring reeling area on the take-up reeling; and a clutch selectively causing multiple teeth on the bottom of the take-up reel to engage or disengage from the annular toothed ring in the U-shaped mounting bracket, and being composed of:

a coil spring mounted inside the spring chamber in the take-up reel and pressing against the bottom of the U-shaped mounting bracket to selectively disengage the multiple teeth on the bottom of the take-up reel from the annular tooth ring; and a cam assembly mounted on the take-up reel and selectively pressing the take-up reel down so the multiple teeth on the bottom engage the annular toothed ring to hold the take-up reel in place, wherein the cam assembly comprises:

a lower cam mounted inside the cam recess on the top of the take-up reel and slidably on the ratchet post and having a non-circular hole defined through the lower cam and corresponding to and non-rotatably engaging the non-circular section on the ratchet post;

an abutting top face;

multiple convex segments formed on the abutting top face; and multiple concave segments formed alternately with the convex segments on the abutting top surface; and an upper cam rotatably mounted above the lower cam on the ratchet post with a screw and washer and having a central hole defined through the upper cam to make the upper cam to mount rotatably around the distal end of the ratchet post;

a top surface;

an abutting bottom face that presses against the abutting top surface of the lower cam;

multiple convex segment formed alternately with the concave segments on the abutting bottom face and selectively pressing against the convex segments of the lower cam to move the lower cam down; and an activating lever formed on and extending radially from the top surface of the upper cam to rotate the upper cam and having a distal end;

two string-guides mounted on the bottom of the venetian blind on opposite ends of the central reeling device; and a main string attached to the resilient coiling device on the central reeling device, winding around and extending between the two string-guides and connecting to two branched strings that adapt to extend down through the slats of the venetian blind.

2. The cordless activating device as claimed in claim 1, wherein the front wall of the U-shaped mounting bracket has a longitudinal slot defined through the front wall near the top edge; and the distal end of the actuating lever on the upper cam extends through the longitudinal slot.

3. The cordless activating device as claimed in claim 1, wherein the front wall of the U-shaped mounting bracket has a cutout defined in the top edge near a medial position; and the clutch is further composed of a lever actuating assembly composed of a shaft slidably mounted in the cutout in the front wall of the U-shaped mounting bracket, connected to the actuating lever and having a proximal end that selectively pushes the actuating lever inward; and a distal end extending outside the front wall and adapted to be pressed by a user to release the take-up reel.

4. The cordless activating device as claimed in claim 1, wherein the non-circular annular section on the ratchet post is polygonal.

5. The cordless activating device as claimed in claim 3, wherein the actuating lever on the upper cam has a longitudinal 2 elongated slot formed near the distal end;

the shaft of the lever actuating assembly has a protruding coaxial rod formed on and extending from the proximal end of the shaft and a pin hole formed radially in the protruding coaxial rod;

a pin is mounted in the longitudinal elongated slot in the actuating lever and the pin hole in the protruding coaxial rod to connect the shaft to the actuating lever; and a resilient element is mounted around the protruding coaxial rod and against the rear wall of the U-shaped mounting bracket to press the shaft outward, rotate the actuating lever, press the take-up reel down and lock the take-up reel in position.

6. The cordless activating device as claimed in claim 3, wherein the actuating lever on the upper cam has a perpendicular abutting post formed near the distal end;

the spring spool has a spring post formed on and extending longitudinally from the top; and a resilient element is mounted around the spring post on the spring reel and has a first end abutting the rear wall of the U-shaped mounting bracket and a second end pressing against the perpendicular abutting post on the actuating lever top press the actuating lever and the shaft toward the front wall of the mounting bracket.

7. The cordless activating device as claimed in claim 1, wherein each string-guide comprises:

a sheave mounting bracket; and a sheave rotatably mounted on the sheave mounting bracket.

* * * * *